United States Patent [19]

Ohno

[11] 4,057,191

[45] Nov. 8, 1977

[54] GRINDING METHOD

[76] Inventor: Ietatsu Ohno, 1-2, 1-chome Kasuya, Setagaya, Tokyo, Japan

[21] Appl. No.: 717,010

[22] Filed: Aug. 23, 1976

[51] Int. Cl.[2] ..... B02C 17/14

[52] U.S. Cl. ..... 241/30; 51/164; 241/175

[58] Field of Search ..... 241/26, 30, 175, 176, 241/177; 51/164; 259/72

[56] References Cited

U.S. PATENT DOCUMENTS

| | | | |
|---|---|---|---|
| 3,030,082 | 4/1962 | Matzen et al. | 259/72 |
| 3,164,328 | 1/1965 | Van Dornick | 241/30 X |
| 3,206,128 | 9/1965 | MacPherson et al. | 241/26 |
| 3,392,925 | 7/1968 | Moore | 241/175 |
| 3,981,488 | 9/1976 | Ratowsky | 259/72 |

*Primary Examiner*—Roy Lake
*Assistant Examiner*—Howard N. Goldberg
*Attorney, Agent, or Firm*—Laurence R. Brown

[57] ABSTRACT

A grinding method wherein a cylindrical or polygonal tank of any material and a proper length is lined on the inside surface with any of such materials as a rubber, synthetic resin, brush, fiber and paper pulp. The tank is held in a universal joint at one end and is rotated at the other end. Thus, grinding agents and materials to be ground are put into the tank at the held end. A centrifugal motion is generated on the inner peripheral surface of the tank and the materials will flow to the other end and be ground while rotating spirally due to the centrifugal force on the inner peripheral surface of the tank while in contact with grinding agents.

2 Claims, 3 Drawing Figures

GRINDING METHOD

This invention relates to a grinding method and apparatus wherein a cylindrical or polygonal tank of a proper length is rotatably held at one end and is made to make a circular motion at the other end. Alternatively the tank may be made to make any proper circular motions at both ends so that things to be ground put into the tank through one end will be made to flow while being ground by the centrifugal force for automatic discharge at the other end.

An object of the invention is to provide a centrifugal flow continuous grinding method.

Another object is to grind materials quickly, smoothly and positively within a short time.

Figure 1:
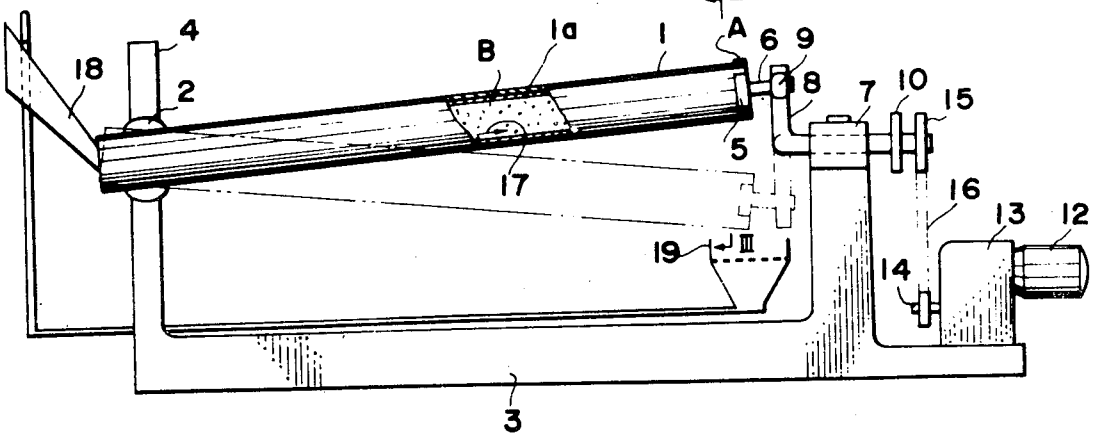
FIG. 1 is a partly sectioned side view of apparatus performing the method according to the present invention.

In the drawings, the reference numeral 1 designates a cylindrical or polygonal grinding tank of a proper length pasted or lined on the inside surface 1*a* with rubber, wood, paper, cloth, plastics, synthetic resin, leather, metal, brush or the like. The tank is held at one end in a frame 4 provided on a mount body 3 by a universal bearing 2. The other end is attached to an arm frame 5 fitted at both ends with driving pin shafts 6. A crank arm 8 is borne by each of two bearings 7 provided on the mount body 3. Pin shaft 6 is pivoted at one end by a universal bearing 9 located in the end of a crank shaft 8 connecting operatively through bearing 7 with gear or pulley 10,15 driven through a chain or belt 11.

A motor 12 fitted to the mount body 3 can have the number of revolutions freely varied by a speed change gear 13. The chain or belt 16 is connected between a gear or pulley 14 fitted to the shaft of the motor 12 and a driving gear or pulley 15 fitted to the shaft of one of the crank arms 8.

Figure 3:
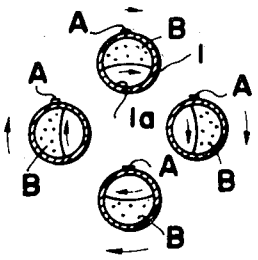
FIG. 3 is a sectioned view on line III—III in FIG. 1, showing the flowing states of materials in the tank in respective positions in the circular motion of the tank.
Figure 2:
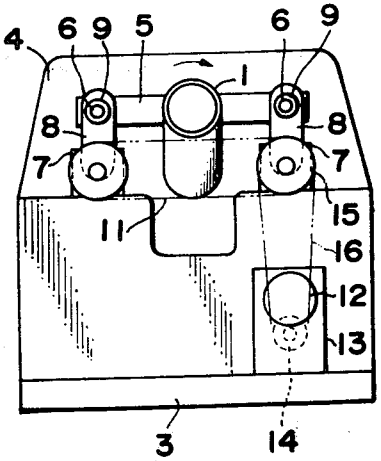
FIG. 2 is an elevation of FIG. 1 from the right.

In such apparatus, when the motor 12 is driven, the crank arms 8 will rotate and the tank 1 will make a circular motion at one end. In this mode of operation, the tank will make a circular motion at the end but will not itself rotate as shown in FIG. 3. That is to say, one point A at the end of the tank will be always directed upward. Therefore, the things to be ground and grinding agents B put into the tank will flow while describing a circle along the inner peripheral surface 1a due the centrifugal force as indicated by the arrow (see FIG. 3) and will be at the same time moved in the axial direction of the tank as indicated by the arrow 17 in FIG. 1.

Therefore, if the things to be ground and grinding agents are put into the tank 1 through an inlet port 18 at the left end, they will flow while spirally moving on the inner peripheral surface 1a due to the centrifugal force, while being automatically ground and will be taken out through the other end.

Needless to say, the outflowing time can be varied by varying the rotating velocity and radius of rotation. It is clear that it can be varied also by the length. Further, the ground things and grinding agents flowing out may be received with a receiver 19 and then sorted and only the grinding agents thereof fed back into the inlet port 18.

Thus, in the present invention the tank is pivoted at one end and makes a circular motion at the other end so that the things to be ground will flow spirally therethrough. Accordingly, grinding efficiency is high, the grinding is fast, smooth and positive and furthermore the apparatus is simple.

I claim:

1. The grinding method comprising in combination the steps of:

a. confining a longitudinal hollow tank at one end in a fixed universal joint for limited rotational movement, said hollow tank having an internal surface lining, b. feeding materials to be ground with a grinding agent in said first end of the tank, c. grinding said materials by moving the opposite end of said tank in an arcuate path without rotating the tank, whereby the materials are ground by engaging the grinding agent and circling the inner peripheral lining of the tank as they flow from said one end to said opposite end of the tank, and d. extracting materials and grinding agent from the said opposite end of the tank.

2. The grinding method of claim 1, wherein the arcuate path consists of circular rotation.

* * * * *